US007729646B2

(12) United States Patent
Fujiwara et al.

(10) Patent No.: US 7,729,646 B2
(45) Date of Patent: Jun. 1, 2010

(54) IMAGE FORMING APPARATUS

(75) Inventors: Motohiro Fujiwara, Toride (JP); Akihiro Noguchi, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 12/249,706

(22) Filed: Oct. 10, 2008

(65) Prior Publication Data

US 2009/0097887 A1 Apr. 16, 2009

(30) Foreign Application Priority Data

Oct. 11, 2007 (JP) ..... 2007-265680

(51) Int. Cl.
*G03G 15/09* (2006.01)

(52) U.S. Cl. ..... 399/274

(58) Field of Classification Search ..... 399/274, 399/284, 98, 99, 261
See application file for complete search history.

(56) References Cited

U.S. PATENT DOCUMENTS 4,398,817 A * 8/1983 Nishimura et al. ..... 399/225
4,633,808 A * 1/1987 Maekawa ..... 399/270
2007/0110482 A1 5/2007 Kazaki et al.

FOREIGN PATENT DOCUMENTS

| | | |
|---|---|---|
| JP | 61-103176 | 5/1986 |
| JP | 3-38669 | 2/1991 |
| JP | 11-231645 | 8/1999 |
| JP | 2001-083757 | 3/2001 |
| JP | 2007-140062 | 6/2007 |

* cited by examiner

*Primary Examiner*—David P Porta
*Assistant Examiner*—Kiho Kim
(74) *Attorney, Agent, or Firm*—Canon USA Inc IP Div

(57) ABSTRACT

An image forming apparatus includes a plurality of vibration members configured to vibrate a regulating member that regulates a developer layer thickness on a developer bearing member, and a control unit that can execute a vibration mode which vibrates the plurality of vibration members during different periods so that the plurality of vibration members do not vibrate simultaneously when an image is not being formed.

10 Claims, 14 Drawing Sheets

IMAGE FORMING APPARATUS

BACKGROUND OF THE INVENTION

1. Field of the Invention

The present invention relates to an image forming apparatus that forms an image using an electrophotographic method. In particular, the present invention relates to an image forming apparatus such as a copying machine, a printer, a facsimile, or a multifunction peripheral including the aforementioned plurality of functions.

2. Description of the Related Art

Conventionally, an image forming apparatus using an electrophotographic method generally includes a drum-shaped photosensitive member 1 as an image bearing member as illustrated in FIG. 1. In such an image forming apparatus, a charger 2 uniformly charges a surface of the photosensitive member 1, and an exposure device 3 exposes the charged photosensitive member 1 according to image information. Consequently, an electrostatic image is formed on the photosensitive member 1. The electrostatic image is then visualized by toner in a developer using a developing device 4 and thus becomes a toner image. A transfer device 5 transfers the visualized toner image to a recording material S, and a fixing device 6 fuses and fixes the toner image on the recording material S by applying heat and pressing force.

After the above-described transferring process is performed, a cleaning device 7 removes residual toner on the photosensitive member 1. Further, a neutralization device 8 removes any remaining charge on the photosensitive member 1 to prepare for the next image forming process.

The developing device 4 can use a two-component developer including non-magnetic toner particles (toner) and magnetic carrier particles (carrier). Since the two-component developer does not have to include a magnetic substance in the toner, a favorable color can be acquired. Consequently, the two-component developer is widely-used particularly in a color image forming apparatus.

An example of a general configuration of the developing device 4 using a two-component developer is illustrated in FIGS. 3 and 4.

Referring to FIGS. 3 and 4, the developing device 4 includes a developer container 41 that contains the developer. The developer container 41 is divided into a developing chamber (developer conveyance path) 41*a* and an agitating chamber (developer conveyance path) 41*b* by a partition wall 41*c* that is extended in a perpendicular direction.

A first developer convey agitating member 42 and a second developer convey agitating member 43 are formed in the developing chamber 41*a* and the agitating chamber 41*b* respectively. Further, transferring portions (developer conveyance paths) 41*d* and 41*e* are formed at edges of the partition wall 41*c* in a longitudinal direction to allow the developer to pass between the developing chamber 41*a* and the agitating member 41*b*. The first and second developer convey agitating members 42 and 43 agitate and convey the developer, so that the developer is circulated inside the developer container 41. A developing sleeve 44 as a developer bearing member is rotatably disposed at a position facing the photosensitive member 1. A magnet 45 as a magnetic field generation unit is fixedly disposed inside the developing sleeve 44.

The magnet 45 in the developing device 4 includes 3 or more poles. The developer agitated by the first developer convey agitating member 42 is attracted by a magnetic force of a convey magnetic pole N2 (lift pole) for lifting the developer. The developer is then conveyed to a developer reservoir portion 48 by rotation of the developing sleeve 44. The amount of the developer is regulated by a developer back member 47. Further, the developer is sufficiently attracted by a convey magnetic pole (cut pole) S2 having a predetermined magnetic flux density or more to stably attract an amount of developer, and conveyed while forming a magnetic brush.

A regulating blade 46 that regulates a layer thickness of the developer cuts the tip of the magnetic brush to make a developer amount appropriate. The convey magnetic pole N1 then conveys the developer to a position facing the photosensitive member 1, and the developer is supplied for development in a developing pole S1. At the position facing the photosensitive member 1, only the toner is transferred to an electrostatic image formed on the surface of the photosensitive member 1 by a developing bias applied on the developing sleeve 44. As a result, a toner image is formed on the surface of the photosensitive member 1 according to the electrostatic image.

In the above-described image forming apparatus, if a foreign substance is caught between the developing sleeve 44 and the regulating blade 46, a developer coat becomes thin in the region where the foreign substance is caught. Consequently, the density of the developer becomes thin.

To solve such a problem, Japanese Patent Application Laid-Open No. 11-231645 discusses a method of removing the foreign substance that is caught between the developing sleeve 44 and the regulating blade 46 by installing a member that vibrates the regulating blade 46 itself.

However, a problem arises in a case where the method discussed in Japanese Patent Application Laid-Open No. 11-231645 is applied to an image forming apparatus which includes a plurality of developing devices that each develops images on a plurality of drums. That is, if the vibration member which vibrates the regulating blade of each developing device is simultaneously vibrated, noises produced due to vibration can be overlapped, so that very loud noise is generated.

SUMMARY OF THE INVENTION

The present invention is directed to an image forming apparatus that can regulate noise generated due to a developer layer thickness regulating member to prevent growth of a toner layer originating in the regulating member. At the same time, the image forming apparatus can acquire a favorable image without image defect.

Further, the present invention is directed to an image forming apparatus that does not generate an image defect due to a foreign substance generated by vibration of a developer layer thickness regulating member. In addition, down time of image formation is minimized in the image forming apparatus.

According to an aspect of the present invention, an image forming apparatus includes a plurality of image bearing members on which an electrostatic image is formed, and a plurality of developing devices that are disposed corresponding to the plurality of image bearing members and contain a developer including a magnetic carrier and toner. The plurality of developing devices each includes a developer bearing member configured to rotate while bearing a developer that includes different colors of toner and to supply toner to an electrostatic image on the image bearing member at a position facing the image bearing member to form a toner image, and a regulating member configured to regulate a developer layer thickness on the developer bearing member. The image forming apparatus further includes a plurality of vibration members configured to vibrate each regulating member, and a control unit that can execute a vibration mode which vibrates the plurality of vibration members during different periods so that the plurality of vibration members do not vibrate simultaneously when an image is not being formed.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
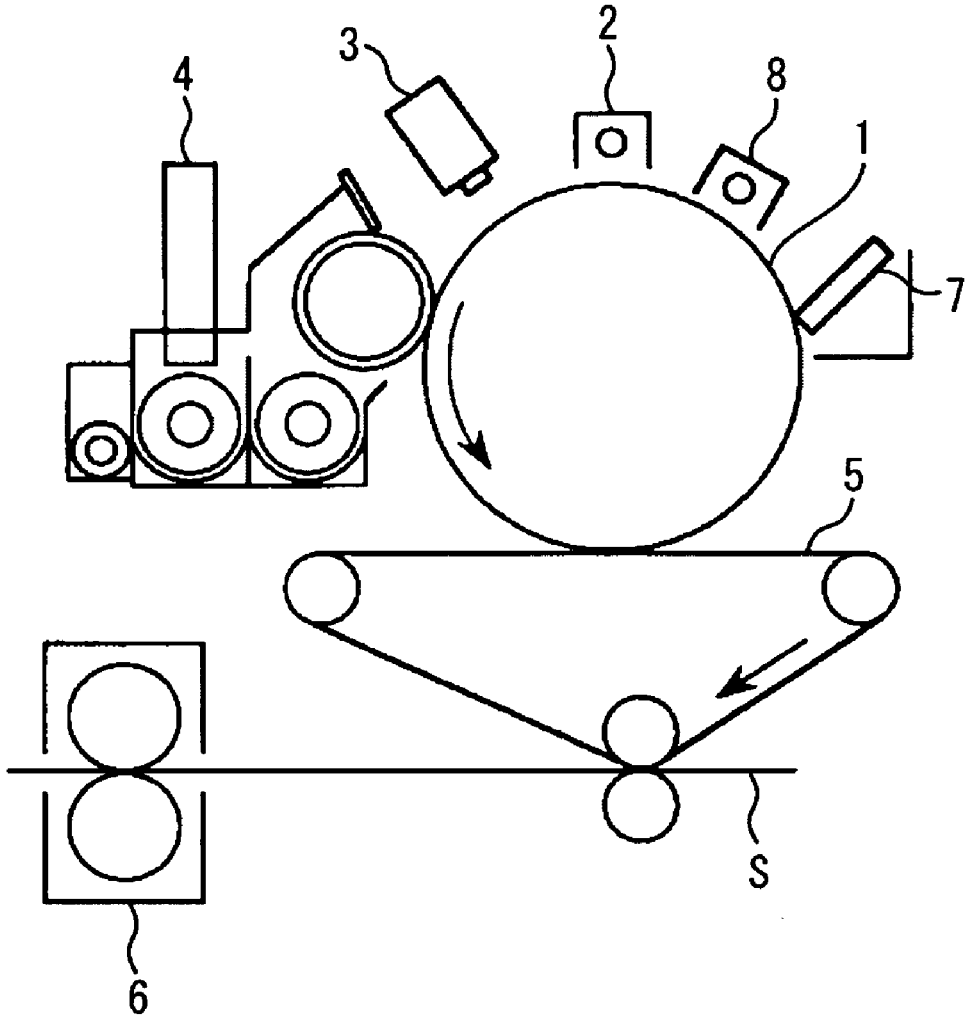
FIG. 1 PRIOR ART
FIG. 1 illustrates a cross-sectional view of a conventional image forming apparatus.
Figure 2:
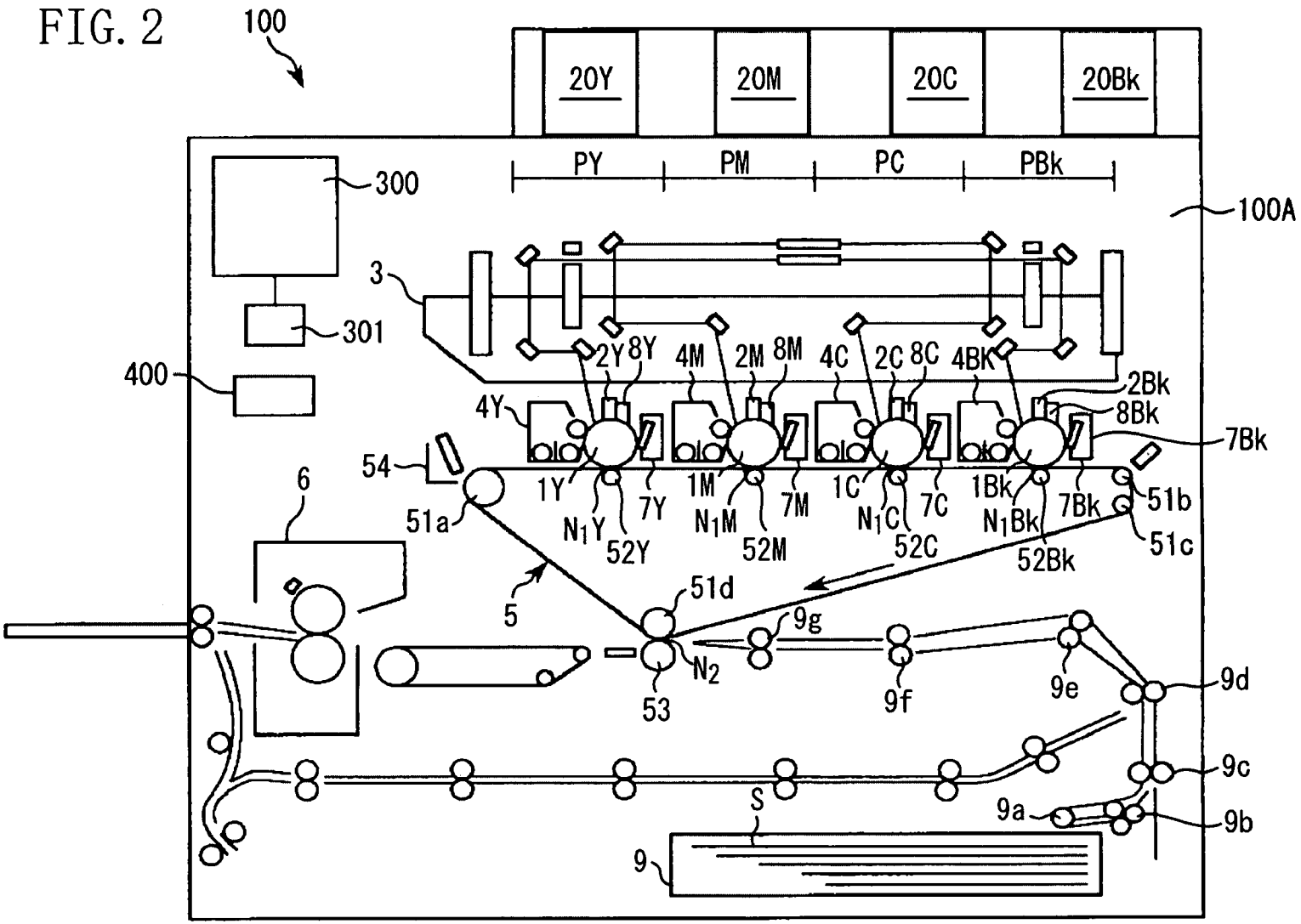
FIG. 2 illustrates a cross-sectional view of an image forming apparatus according to a first exemplary embodiment of the present invention.

Configuration and operation of an image forming apparatus according to a first exemplary embodiment of the present invention will be described below. FIG. 2 illustrates a cross-sectional view of an image forming apparatus according to the first exemplary embodiment.

In the present exemplary embodiment, an image forming apparatus 100 is a 4-drum full-color printer of tandem type using an electrophotographic method. Image information is input to the image forming apparatus 100 from a document reading apparatus connected to an image forming apparatus main body (main body) 100A, or a host apparatus such as a personal computer which is communicably connected to the main body 100A. The image forming apparatus 100 can form a full-color image of four colors including yellow (Y), magenta (M), cyan (C), and black (Bk), on a recording material (e.g., recording sheet, plastic sheet, or cloth) S, according to the input image information.

Further, the image forming apparatus 100 includes first, second, third, and fourth image forming portions P (i.e., PY, PM, PC, and PBK) as a plurality of image forming units that form images of the four colors, Y, M, C, and Bk. In the drawings, such as FIG. 2, the components are denoted according to the particular image forming portion (i.e., Y, M, C, or Bk). However, unless the components are different between the image forming portions, the components will not be differentiated in the specification. An intermediate transfer belt 51 constituting the transfer device 5 moves in a direction of an arrow illustrated in FIG. 2 and passes through each image forming portion P. At that time, each image forming portion P superimposes an image of each color on the intermediate transfer belt 51. A multiple toner image superimposed on the intermediate transfer belt 51 is then transferred onto the recording material S, so that a recorded image can be acquired as an output.

In the present exemplary embodiment, each image forming portion P is similarly configured except for the difference in a development color. Therefore, hereinafter, letters Y, M, C, and Bk that are added to the image forming portion P to indicate a particular image forming portion will be omitted. The image forming portions will be described collectively in a case where it is not necessary to distinguish among the image forming portions.

The image forming portion P includes the photosensitive member (hereinafter referred to as a photosensitive drum) 1 as a drum-type image bearing member. The charger 2 as a charging unit and the exposure device 3 as an exposing unit are disposed on the outer periphery of the photosensitive drum 1. Further, the developing device 4 as a developing unit, the transfer device 5 as a transferring unit, the cleaning device 7 as a cleaning unit, and the neutralization device 8 as a charge removing unit are disposed around the photosensitive drum 1.

As described above, the transfer device 5 includes the intermediate transfer belt 51 as an intermediate transfer member. The intermediate transfer belt 51 is extended around a plurality of rollers 51*a*, 51*b*, 51*c*, and 51*d*, and is rotated (moved around) in a direction indicated by an arrow illustrated in FIG. 2. Further, a primary transfer roller 52 as a primary transfer member is disposed at a position facing each photosensitive drum 1 across the intermediate belt 51. Further, a secondary transfer roller 53 as a secondary transfer member is disposed at a position facing the roller 51*d* that is one of the rollers around which the intermediate transfer belt 51 is extended.

In an image forming process, the charger 2 uniformly charges a surface of the rotating photosensitive drum 1. An image processing apparatus 300 then converts image information input to the apparatus main body 100A into a pixel image signal to be used to drive the exposing device 3, i.e., the laser exposing optical system in the present exemplary embodiment. Consequently, the exposing device 3 scans and exposes the surface of the charged photosensitive drum 1 according to the image information signal and forms an electrostatic image on the photosensitive drum 1.

The electrostatic image formed on the photosensitive drum 1 is visualized as a toner image using each of the developing devices 4 whose developers are of different colors, disposed corresponding to each photosensitive drum 1. In the present exemplary embodiment, the developing device 4 uses a two-component developer including non-magnetic toner particles (toner) and magnetic carrier particles (carrier) as a developer. A hopper 20 replenishes toner in the developing device 4 according to a consumed amount of toner.

A video count unit 301 integrates the image signal received from the image processing apparatus 300 for each image. The video count unit 301 then calculates a number of video counts to be used in controlling developer replenishment (video count ATR) from the developer replenishing device, i.e., hopper 20, to the developing device 4.

The developing device 4 according to the present exemplary embodiment will be described below. The developing device 4 is configured similar to the developing device described above with reference to FIGS. 3, 4, and 5.

Figure 3:
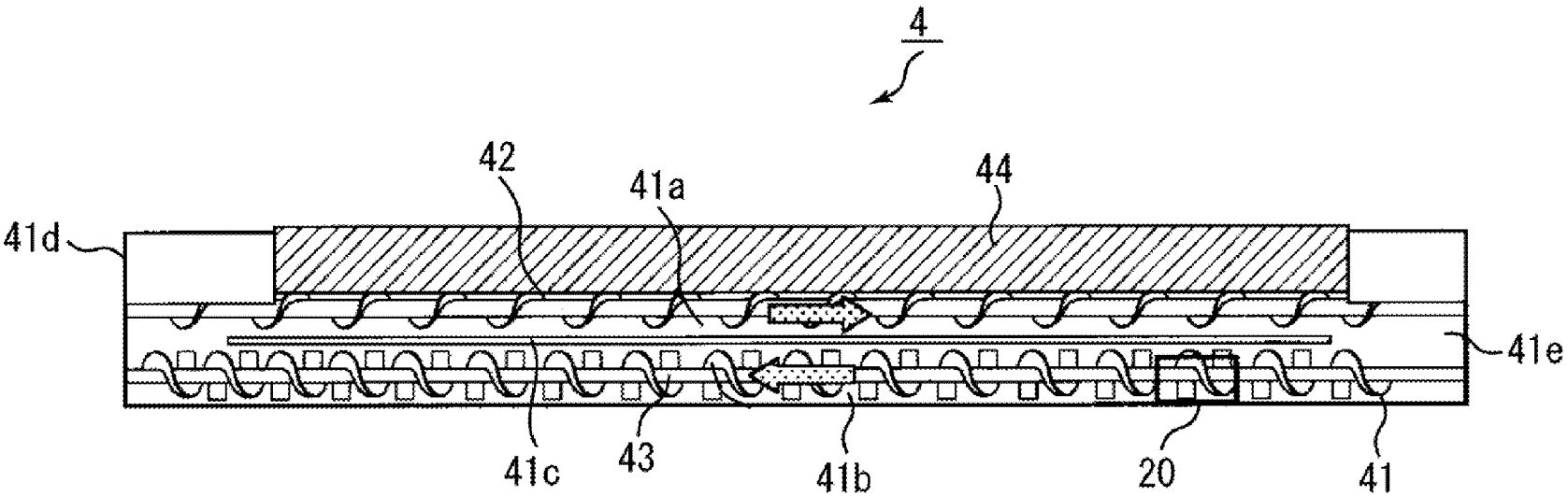
FIG. 3 illustrates a top view of a developing device to which the present invention is applied.
Figure 4:
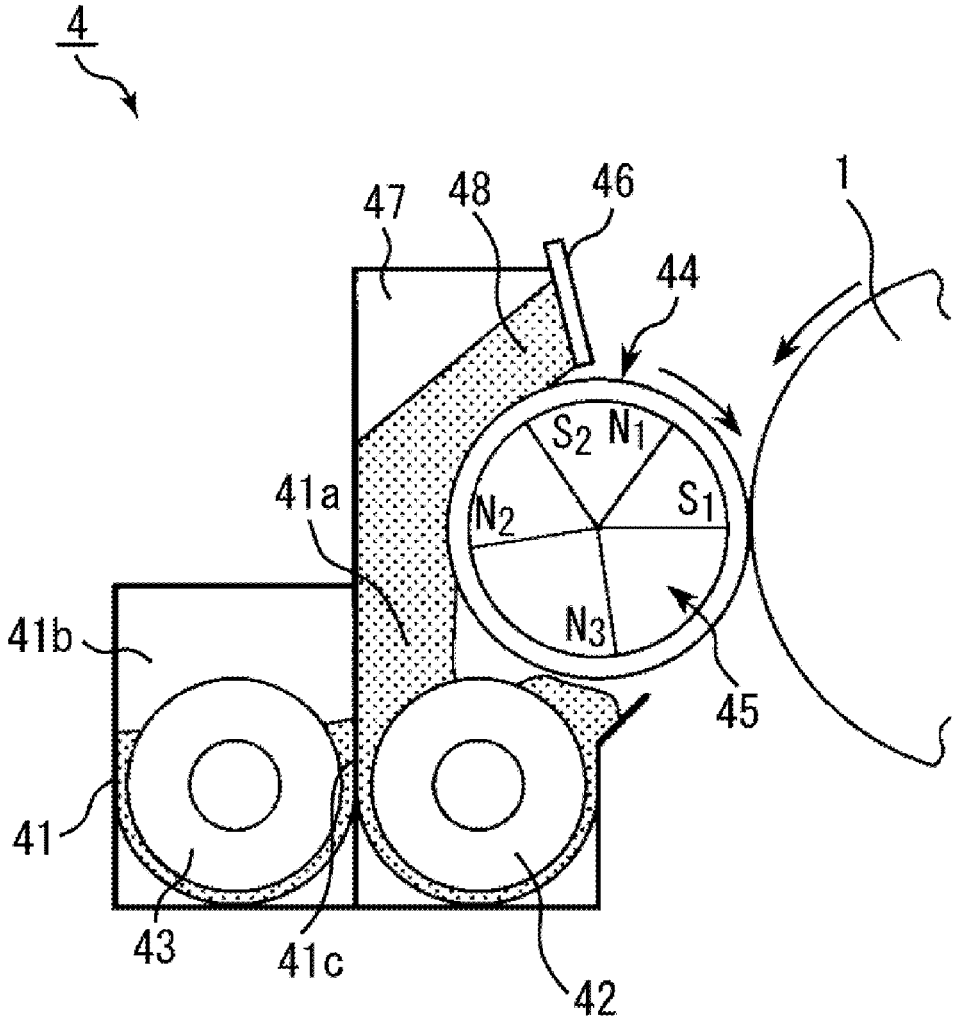
FIG. 4 illustrates a cross-sectional view of a developing device to which the present invention is applied.

Referring to FIGS. 3 and 4, the developing device 4 includes the developer container 41 that contains a developer. The developer container 41 is divided into the developer chamber (developer conveyance path) 41*a* and the agitating chamber (developer conveyance path) 41*b* by the partition wall 41*c* extended in a perpendicular direction.

The first developer convey agitating member 42 and the second developer convey agitating member 43 are formed in the developing chamber 41*a* and the agitating chamber 41*b* respectively. Further, the transferring portions (developer conveyance paths) 41*d* and 41*e* are formed at edges of the partition wall 41*c* in a longitudinal direction, to allow the developer to pass between the developing chamber 41*a* and the agitating member 41*b*. The first and second developer convey agitating members 42 and 43 agitate and convey the developer, so that the developer is circulated inside the developer container 41. A developing sleeve 44 as a developer bearing member is rotatably disposed at a position facing the photosensitive drum 1 in the developer container 41. A magnet 45 as a magnetic field generation unit is fixedly disposed inside the developing sleeve 44.

The magnet 45 in the developing device 4 includes 3 or more poles. The developer agitated by the first developer convey agitating member 42 is attracted by a magnetic force of the convey magnetic pole N2 (draw-up pole) for drawing up the developer. The developer is then conveyed to the developer reservoir portion 48 by rotation of the developing sleeve 44. The amount of the developer is regulated by the developer back member 47. Further, the developer is sufficiently attracted by the convey magnetic pole (cut pole) S2 having a predetermined magnetic flux density or more to attract a stable amount of the developer, and conveyed while forming a magnetic brush.

The regulating blade 46 serving as a member that regulates a layer thickness of the developer, cuts the tip of the magnetic brush to regulate the developer to a proper amount. The convey magnetic pole N1 then conveys the developer to a position facing the photosensitive drum 1, and the developer is supplied for development by the developing pole S1. At the position facing the photosensitive drum 1, only the toner is transferred to the electrostatic image formed on the surface of the photosensitive drum 1 owing to a developing bias applied to the developing sleeve 44. As a result, a toner image is formed on the surface of the photosensitive drum 1 according to the electrostatic image.

As described above, the magnet 45 inside the developing sleeve 44 carries and conveys the developer inside the developing device 4, to develop the electrostatic image formed on the photosensitive drum 1 and form a toner image.

Referring to FIG. 2, a primary transfer bias is applied to the primary transfer member 52 at the primary transfer portion (primary transfer nip) N1 (N1Y, N1M, N1C, and N1Bk) where the intermediate transfer belt 51 contacts the photosensitive drum 1. Consequently, the toner image formed on the photosensitive drum 1 is transferred (primary transferred) to the intermediate transfer belt 51. For example, when a full-color image using four colors is to be formed, the toner image is sequentially transferred, from the photosensitive drum 1 of the first image forming portion PY up to the fourth image forming portion PBK, to the intermediate transfer belt 51. As a result, a multiple toner image in which toner images of four colors are superimposed is formed on the intermediate transfer belt 51.

The recording material S contained in a cassette 9 serving as a recording material containing unit is fed one by one to a pick-up roller 9*a*. The recording material S is then conveyed by a recording material conveying member, i.e., the conveying rollers 9*b*, 9*c*, 9*d*, 9*e*, and 9*f* and the resist roller 9*g*. The recording material S is supplied to a second transfer portion (nip portion) N2 at which the intermediate transfer belt 51 contacts the second transfer member 53, in synchronization with the toner image on the intermediate transfer belt 51. As a result, the multiple toner image on the intermediate transfer belt 51 is transferred to the recording material S by a secondary transfer bias applied to the secondary transfer member 53 at the secondary transfer portion N2.

The recording material S which is separated from the intermediate transfer belt 51 is then conveyed to the fixing device 6. The fixing device 6 heats and presses the toner image transferred onto the recording material S, so that the toner image is fused and fixed on the recording material S. The recording material is then discharged to the outside of the image forming apparatus 100.

The cleaning device 7 retrieves foreign substance such as toner remaining on the photosensitive drum 1 after the primary transfer process. Further, the neutralization device 8 removes the electrostatic image remaining on the photosensitive drum 1. As a result, the photosensitive drum 1 becomes prepared for the next image forming process. Further, an intermediate transfer belt cleaner 54 removes foreign substance such as toner remaining on the intermediate transfer belt 51 after the secondary transfer process.

The image forming apparatus 100 according to the present exemplary embodiment can form a single color or a multicolor image such as a black color image, using the image forming portion of a desired single color or some colors among the four colors.

The two-component developer used in the present exemplary embodiment will be described below.

A toner includes coloring resin particles containing binder resin, colorant, and other additives as necessary, and coloring particles to which an external additive, such as fine powder of colloidal silica, is externally added. Further, the toner is a negatively chargeable polyester resin. It is useful that a volume-average particle diameter of the toner is not less than 5 μm and not more than 8 μm. In the present exemplary embodiment, the volume-average particle diameter is 7.0 μm.

Further, metals either oxidized or not oxidized on the surface, such as iron, nickel, cobalt, manganese, chromium and rare earths, their alloys and oxide ferrites, can be suitably used as a carrier. There is no particular limitation regarding the method of manufacturing these magnetic particles. The volume-average particle diameter of the carrier is 20 to 50 μm, or desirably 30 to 40 μm. A resistivity of the carrier is greater than or equal to $10^7$ Ω·cm, or desirably $10^8$ Ω·cm. The magnetic carrier used in the present exemplary embodiment is 40 μm in volume-average particle diameter, $5\times10^7$ Ω·cm in resistivity, and 260 emu/cc in magnetization level.

The volume-average particle diameter of the toner used in the present exemplary embodiment is measured by an apparatus and a method described below.

Measurement apparatuses used were a TA-II type Coulter counter (a product of Beckman Coulter, Inc.), an interface for outputting the average distribution of a number of particles and of volume (a product of Nikkaki-bios, Inc.), and a CX-I personal computer (a product of Canon Inc.). A 1% aqueous NaCl solution prepared using first class sodium chloride was used as the electrolytic aqueous solution.

The measurement method was as follows. 0.1 ml of a surface activating agent, desirably alkyl benzene sulfonate, was added as a dispersant to 100 to 150 ml of the above-described electrolytic aqueous solution. Further, 0.5 to 50 mg of a measurement sample was added.

The electrolytic aqueous solution in which the sample was suspended was subjected to dispersion for about 1 to 3 minutes by an ultrasonic disperser, and the distribution of particles of 2 to 40 μm in size was measured by the TA-II type Coulter counter using an aperture of 100 μm to figure out the average-volume distribution, from which the average-volume particle diameter was obtained.

Further, the resistivity of a carrier used in the present exemplary embodiment was measured using a sandwich type cell of 4 cm measurement electrode area at a space of 0.4 cm between the electrodes. Further, a voltage E (V/cm) is applied between the two electrodes under a weight of 1 kg brought upon one of the electrodes. The resistivity of the carrier was thus measured from a current flowing in the circuit.

Figure 5:
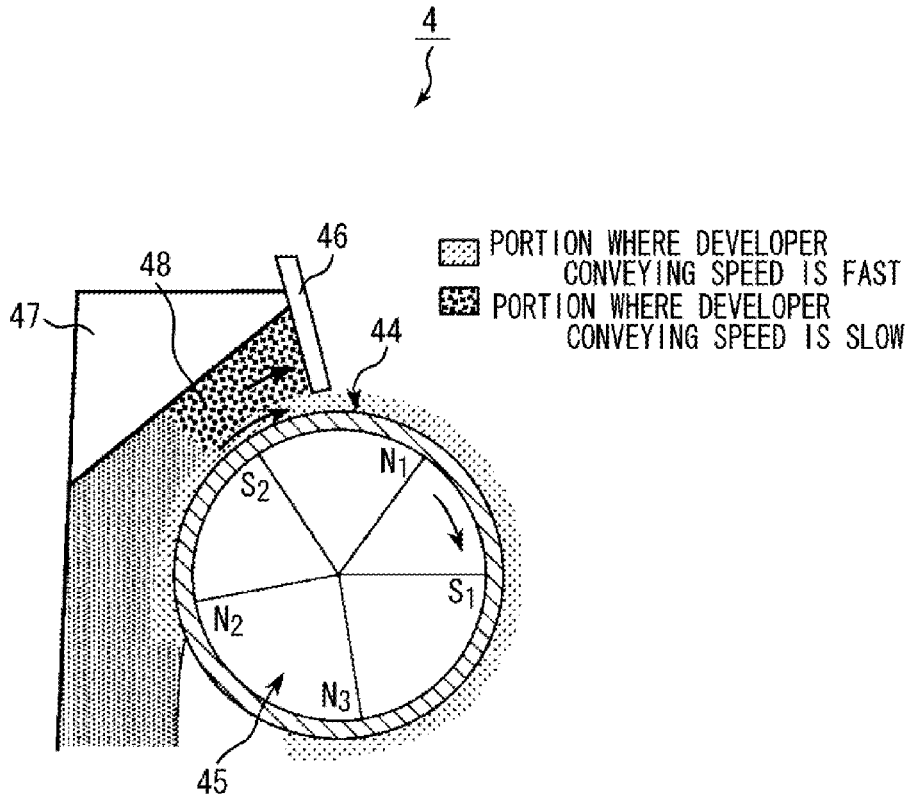
FIG. 5 illustrates a partially enlarged cross-sectional view near a developer reservoir portion in a developing device to which the present invention is applied.

The developing device 4 is described in detail below. FIG. 5 illustrates an enlarged view near the developer reservoir portion 48 in the developing device 4 according to the present exemplary embodiment.

A developer conveying speed near the developing sleeve 44 and a developer conveying speed in the developer reservoir portion 48 near the regulating blade 46 differ greatly, so that a shear surface is formed. A difference in the flow of the developer in the shear surface causes the toner to become disengaged, and as a result, a soft toner layer is generated. When such a toner layer grows, the toner layer blocks the gap between the regulating blade 46 and the developing sleeve 44. Consequently, a coat amount of the developer on the developing sleeve 44 becomes less where the toner layer has grown as compared to other regions, so that there is a decrease in image density.

To solve such a problem, vibration is applied to the regulating blade 46 in the present exemplary embodiment. Consequently, the soft toner layer in the developer reservoir portion 48 near the regulating blade 46 is moved and loosened. The toner layer is then discharged outside the regulating blade 46, so that the coat amount of the developer is prevented from decreasing.

The above-described soft toner layer is an aggregate including only toner, or a developer mass of very high toner concentration. After such an aggregate, i.e., a foreign substance, is loosened by vibration, a portion of the aggregate is shifted to an area where the developer conveying speed is fast and is quickly discharged outside the regulating blade 46. However, the remaining portion shifts to an area where the developer conveying speed is slow and is discharged outside the regulating blade 46 after a certain period of time. Since the aggregate is toner, if the aggregate is discharged outside the regulating blade 46 during an image forming process, the aggregate is developed by the photosensitive drum 1 and thus smears the image. Therefore, it is necessary to stop image formation after vibrating the regulating blade 46 and to rotate the developing sleeve 44 for a while to discharge all of the aggregate.

After being ferried around the developing sleeve 44, the discharged aggregate is removed from the developing sleeve 44 by an N3 pole and the N2 pole that are repelling poles in the developing sleeve 44. The aggregate is then sent to the developing chamber 41*a* and the agitating chamber 41*b* and mixed with the developer in which an appropriate amount of toner circulating inside the developer container 41 is retained. The aggregate thus disappears. An image defect due to the above-described aggregate is more noticeable in a toner image of low brightness.

Table 1 is a table showing brightness of the four colors of toner in the present exemplary embodiment, represented in an L*a*b* color coordinate system. The L*a*b* color coordinate system is one of uniform color spaces.

TABLE 1

| | L* |
|---|---|
| K | 20.2 |
| M | 49.5 |
| C | 51.0 |
| Y | 88.0 |

Referring to table 1, the brightness of toner in a descending order can be described as follows.

$$L^*(K) \ll L^*(M) \leqq L^*(C) \ll L^*(Y)$$

The brightness of toner L* is measured by a method described below.

A brightness L* of a toner in powder form is measured using a spectrophotometer SE 2000 (a product of Nippon Denshoku Industries, Co., Ltd.) that complies with JIS Z-8722. A light source is a C illuminant and the measurement is performed with 2 degrees field of view. The measurement is performed according to the attached instruction manual. However, a reference plate is desirably standardized using a glass of 2 mm thickness and 30 mm diameter in an optional measurement cell for powder. To be more specific, the measurement is carried out in a state where the cell filled with the sample powder is placed on a powder sample holder (attachment) of the spectrophotometer. The brightness L* is measured by filling 80% or more of an inner volume of the cell with the powder sample and subjecting the sample to shaking at 1 shake/second for 30 seconds on a shake table before placing on the powder sample holder.

Generally, a human eye can more easily recognize colors of low brightness due to its visual characteristic. Therefore, when an aggregate causes a smear on an image, a color of low brightness is easily recognized as a smear, so that a user senses degradation in the image quality.

Control of vibrating a vibration member of the developer layer thickness regulating member (regulating blade) which is a feature of the present exemplary embodiment will be described below.

Figure 6:
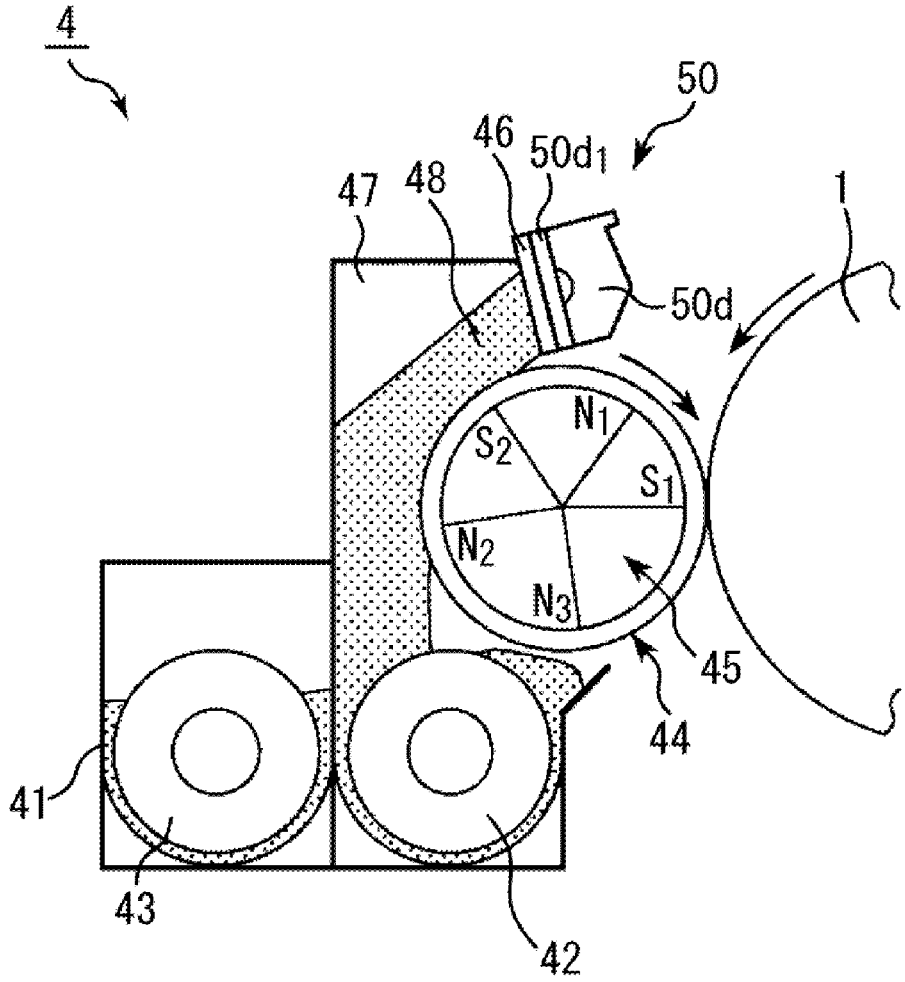
FIG. 6 illustrates a cross-sectional view of a developing device according to an exemplary embodiment of the present invention.

FIG. 6 is a cross-sectional view near the developing device 4 according to the present exemplary embodiment. A vibration member 50 is disposed contacting the regulating blade 46. The vibration member 50 and thus the regulating blade 46 are vibrated by rotating a motor included in the vibration member 50.

Figure 7:
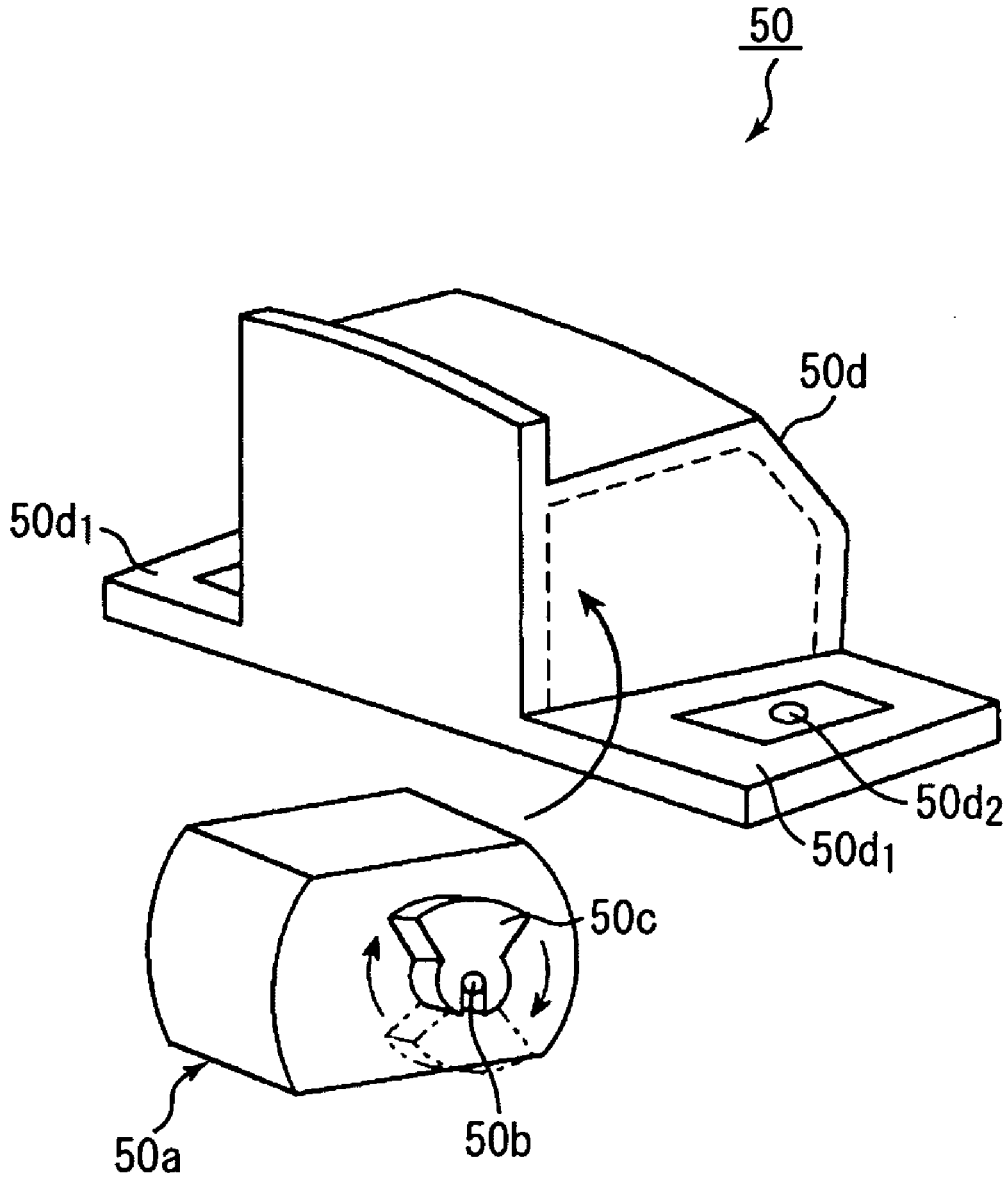
FIG. 7 illustrates a perspective view of a vibration member according to an exemplary embodiment of the present invention.

FIG. 7 illustrates a configuration of the vibration member 50 according to the present exemplary embodiment.

In the present exemplary embodiment, the vibration member 50 includes a motor 50*a*, a spindle 50*c* fixed on an output shaft 50*b* of the motor 50*a*, and a case 50*d*. The case 50*d* includes a fixing portion 50*d*1 and is fixed on the regulating blade 46 by a screw (not illustrated) using a fixing hole 50*d*2 formed on the fixing portion 50*d*1.

The motor 50*a* installed and fixed inside the case 50*d* is connected to a control unit (controller) 400 illustrated in FIG. 2. In the present exemplary embodiment, the motor 50*a* is rotated at 8000 rpm. The spindle 50*c* is fixed in a state where a center of gravity of the spindle 50*c* is deviated from the output shaft 50*b*. Consequently, when the output shaft 50*b* of the motor 50*a* is rotatably driven by a control circuit, the motor 50*a* generates vibration. The vibration is propagated to the case 50*d*, and further to the regulating blade 46. The case 50*d* includes functions of preventing toner from entering the motor 50*a* and efficiently propagating vibration to the regulating blade 46 by containing the motor 50*a*.

The vibration member 50 is not limited to the above-described configuration, if a configuration can generate sufficient vibration to the regulating blade 46 to remove the aggregate.

Figure 12:
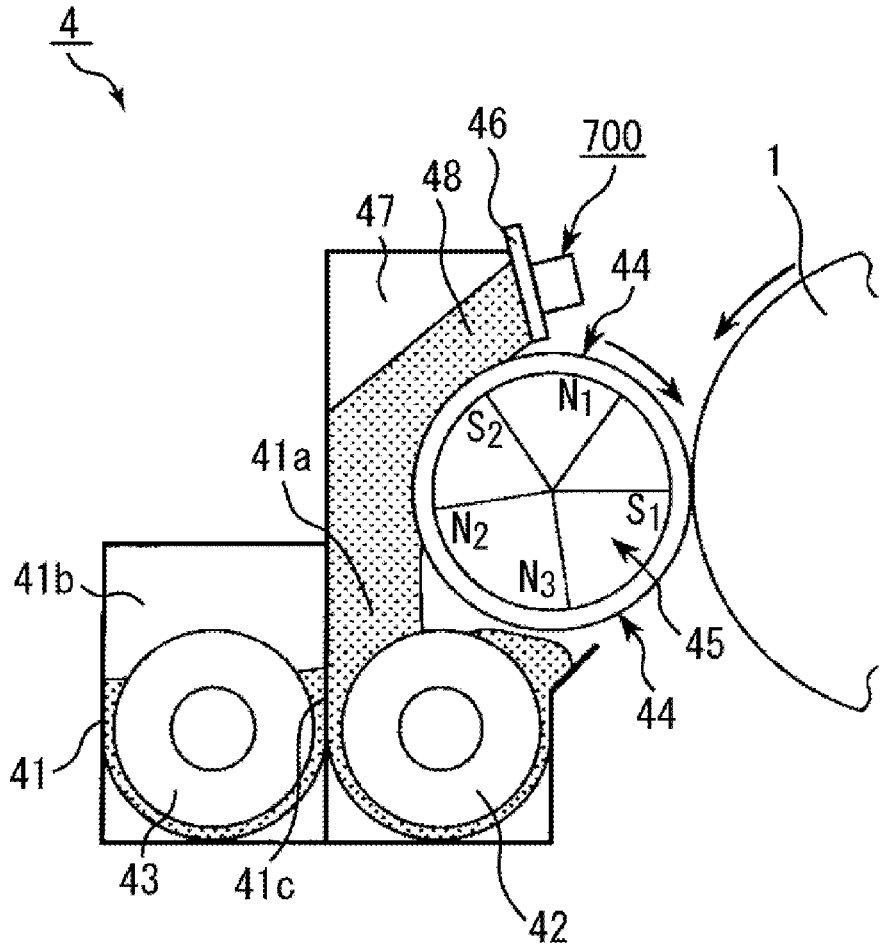
FIG. 12 illustrates a cross-sectional view of a position at which a vibration amount of a regulating blade is measured according to an exemplary embodiment of the present invention.
Figure 13:
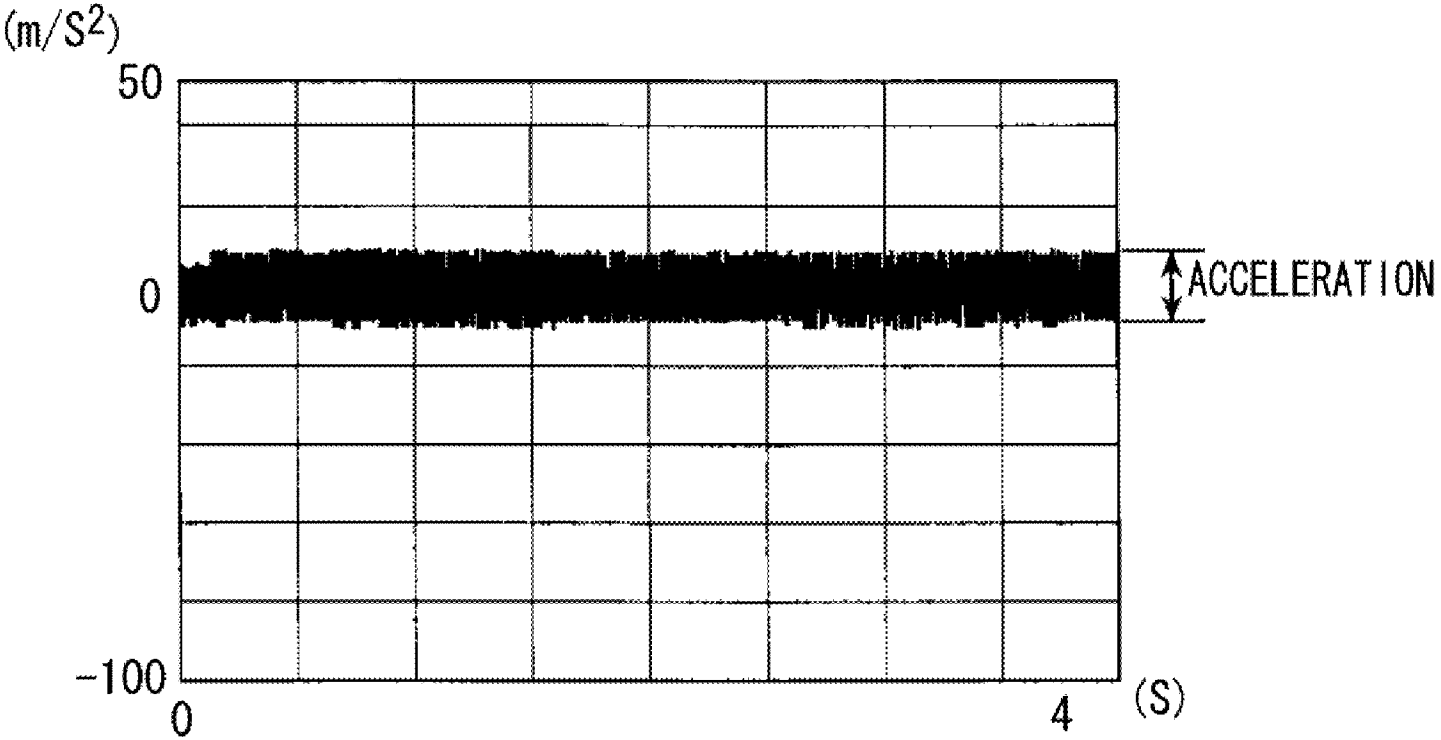
FIG. 13 illustrates an example of a measurement result of acceleration at an acceleration pick-up sensor according to an exemplary embodiment of the present invention.

A method of measuring an amount of vibration will be described below with reference to FIG. 12. Referring to FIG. 12, acceleration of the regulating blade 46 by the vibration member 50 is measured by fixing an acceleration pick-up sensor 700 on the regulating blade 46. FIG. 13 illustrates a measurement result of the acceleration according to the present exemplary embodiment.

Referring to FIG. 13, time (sec) is indicated on the horizontal axis and acceleration ($m/s^2$) is indicated on the vertical axis. FIG. 13 illustrates a state in which the regulating blade 46 is intensely vibrated. Since a time span on the horizontal axis is long, the graph is squashed to be a form of a band. As illustrated in FIG. 13, a measurement result of acceleration by the configuration according to the present exemplary embodiment is approximately 17 $m/s^2$. At such acceleration, the toner layer can be removed by vibrating the vibration member 50 of the regulating blade 46 when the developing sleeve 44 is slightly driven. It is understood as a result of examination by inventors of the present invention that the toner layer can be removed by the above operation when acceleration is 5 $m/s^2$ in the present exemplary embodiment.

Figure 8:
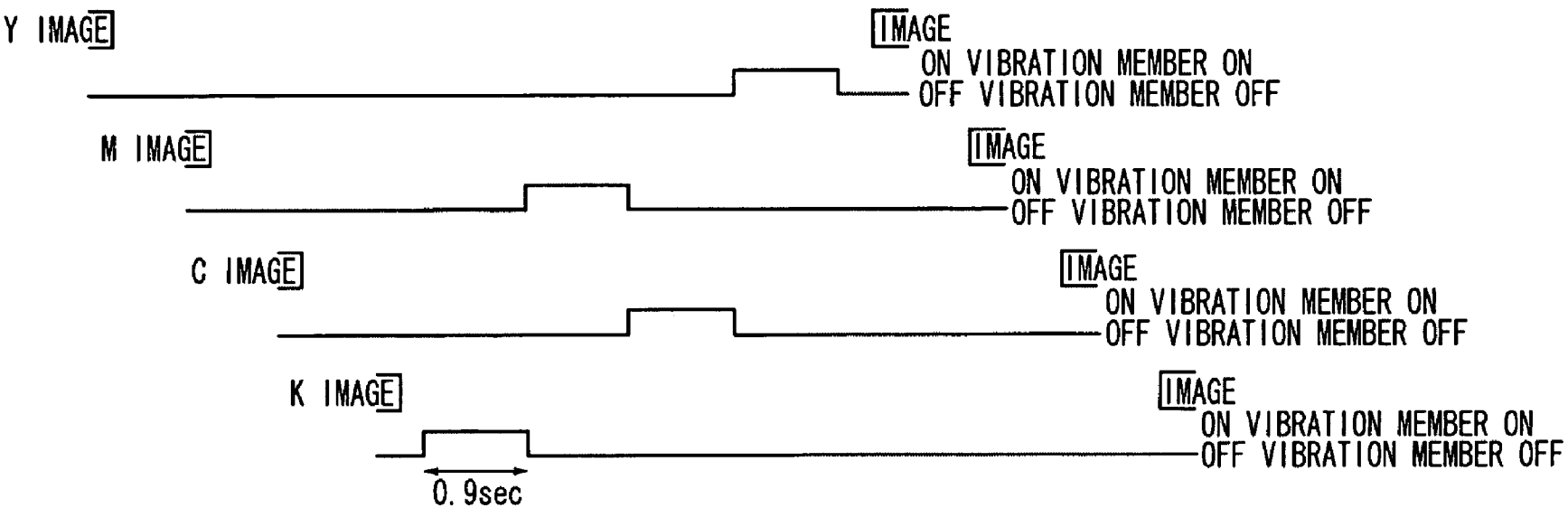
FIG. 8 is a timing chart illustrating timing of vibrating a vibration member according to an exemplary embodiment of the present invention.

FIG. 8 illustrates a timing chart of operation timing in a vibration mode which vibrates a plurality of vibration members 50. Vibration is produced in a non-image forming region between sheets (i.e., in a non-image forming period). "Between sheets" is an interval between image forming regions. The vibration mode can be executed by the control unit 400.

The non-image forming period includes a pre-multi-rotation period, i.e., a preparation operation performed when a power source of the image forming apparatus 100 is switched on, or a post-rotation period after image formation.

In the present exemplary embodiment, a normal time period of a non-image forming region between sheets is 0.16 seconds for A4 size paper. However, when the vibration member 50 is vibrated, the time is extended to 6.75 sec. The vibration member 50 in the developing device 4 of each color is vibrated 0.9 seconds. The noise due to vibration becomes large if the vibration members 50 of the developing devices 4 for all colors are vibrated at the same time. Consequently, the vibration member 50 is separately vibrated for each color during 6.75 seconds of time between sheets. Further, since power consumption while vibrating the vibration member 50 is large, a large power source will be required if the vibrating members 50 are vibrated at the same time, which leads to a rise in cost.

When the noise due to vibration is evaluated by an equivalent noise level (according to JIS Z8731), the following results are achieved. The noise is 55 dB in a normal image formation, 60 dB when the vibration member 50 in the developing device 4 for each color is separately vibrated, and 65 dB when the vibration members 50 for the four colors are simultaneously vibrated. 65 dB is equivalent to highway noise at daytime and is thus an unallowable level in an image forming apparatus. Therefore, in the present exemplary embodiment, the vibration member 50 in each of the developing device 4 is vibrated at a different time and not simultaneously vibrated in the vibration mode.

In the present invention, the order of vibration with respect to color is important. The order is according to the above-described brightness of toner. Since a smear due to the aggregate is more noticeable for toner with lower brightness, the vibration member 50 of the developing device 4 containing toner with lower brightness is vibrated first. As a result, sufficient time can be acquired for the next image, so that the next image formation is performed after all of the aggregate is discharged.

Figure 14:
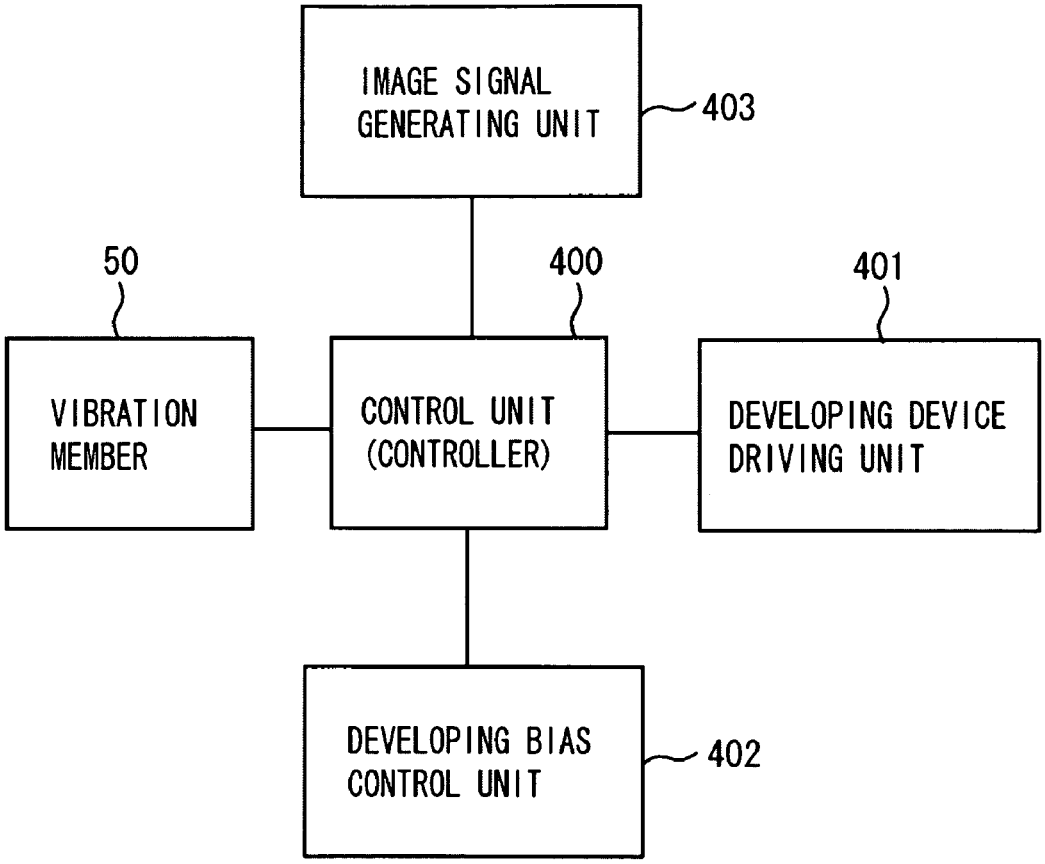
FIG. 14 illustrates a block diagram of control for executing a vibration mode that vibrates a vibration member according to an exemplary embodiment of the present invention.

FIG. 14 illustrates a control block diagram for executing a vibration mode for vibrating the vibration member 50. A control unit 400 is a controller that includes a CPU, a ROM, a RAM and the like, and controls image formation and drive of the vibration member 50. The control unit 400 forms an image by driving the exposure device 3 and the developing device 4 based on the image signal received from an image signal generating unit 403 such as a document reading device. Referring to FIG. 14, the control unit (controller) 400 controls a developing device driving unit 401 so that the developing sleeve 44, the first developer convey agitating member 42, and the second developer convey agitating member 43 of each developing device 4 are rotated during an operating mode. Consequently, the aggregate which is crushed after the regulating blade 46 is vibrated by the vibration mode can be discharged outside via the developing sleeve 44. In addition, the aggregate can be agitated and destructed by the agitating member. Further, the control unit 400 controls a developing bias control unit 402 which controls a developing bias of each developing device 4. As a result, the control unit 400 controls the developing bias of each developing device 4 so that development is not performed during the operation mode.

Generally, a full-color image forming apparatus uses the colors cyan, magenta, yellow, and black. Among these colors, a smear due to an aggregate is barely visible in a toner image of yellow whose brightness is especially high. Therefore, it is important that the vibration member 50 of the developing device 4 containing a yellow developer whose brightness is highest is vibrated last. Image formation can be performed directly after the vibration member 50 of the yellow developer color is ended, so that a length of time between sheets, i.e., time during which image formation is stopped, can be minimized. Further, in general, the brightness of cyan and magenta are almost the same. Consequently, the order of vibrating the vibration members 50 corresponding to cyan and magenta developers is not so important, and it is necessary to first vibrate the vibration member 50 corresponding to a black developer whose brightness is lowest.

That is, in a vibration mode, the vibration is produced in order from the vibration member 50 of the developing device 4 containing a developer whose color is of low brightness to the vibration member 50 of the developing device 4 containing a developer whose color is of high brightness.

A frequency of executing the vibration mode will be described below. The frequency of executing the vibration mode in the present exemplary embodiment can be changed according to an image ratio of an image to be formed.

The image ratio according to the present exemplary embodiment is acquired by calculating a ratio of an area of a toner image to an entire area of a recording material on which the toner image is transferred.

In the present exemplary embodiment, the image forming apparatus 100 includes a measurement unit which measures the image ratio. The above-described video count unit 301 illustrated in FIG. 2 can be a measurement unit. The video count unit 301 calculates the number of video counts by integrating image signals from the image processing apparatus 300 for each image. The video count unit 301 then calculates the amount of image with respect to each recording material on which an image is formed and acquires an image ratio of an output.

When an image ratio of the output is low, an external additive of the toner can be easily disengaged, so that a degree of cohesion becomes higher. As a result of an examination described below, it is understood that when the degree of toner cohesion becomes high, the aggregate can be easily generated.

Figure 9:
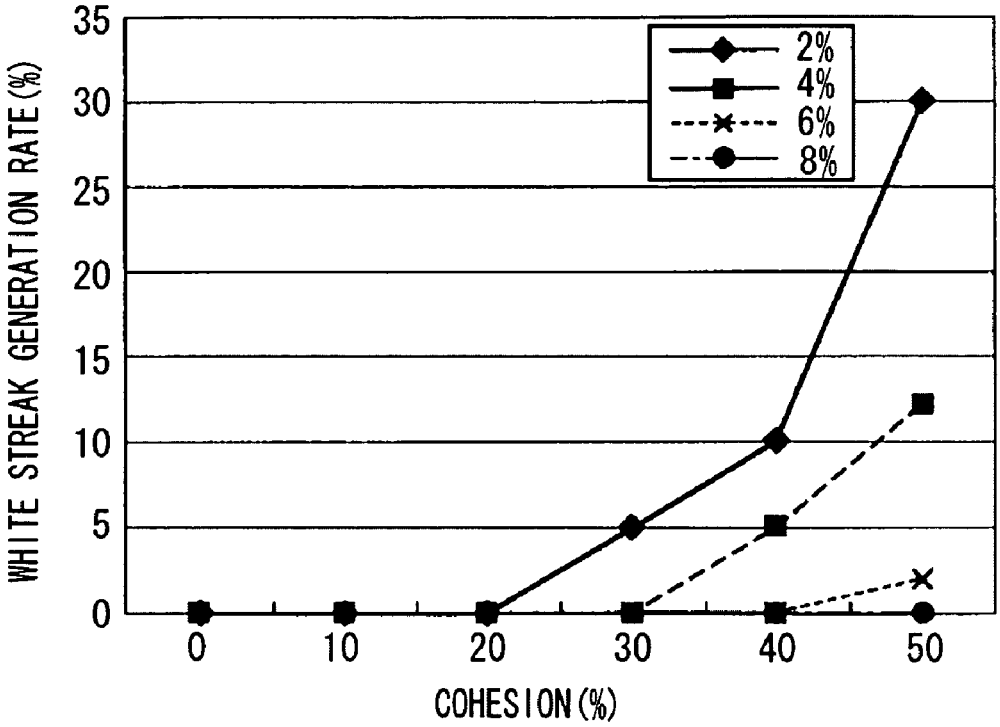
FIG. 9 illustrates a relation between cohesion and white streak generation rate.

For example, FIG. 9 illustrates a relation between cohesion and frequency of aggregate generation. The frequency of aggregate generation was determined under a condition where an image ratio of an output is fixed at 8%, 6%, 4%, and 2%. A solid white image was formed on 300 sheets of A4 paper, and a halftone image formed on a first subsequent sheet was evaluated to determine whether a white streak is formed on the image. The measurement method of cohesion is described below.

Measurement of Cohesion

Three sieves with apertures of 60 mesh, 100 mesh, and 200 mesh respectively are stacked and set on a powder tester (a product of Hosokawa Micron Corp.). A weighed sample of 5 g is gently put on the sieves, and vibration is applied for 15 seconds by setting the voltage input at 17 V. The weight of the sample remaining on each sieve is measured to obtain a cohesion based on the following formula. If an amount of toner in an upper sieve is T, in a middle sieve is C, and in a lower sieve is B respectively, and $$X=T/5\times100$$

$$Y=C/5\times100\times0.6$$

$$Z=B/5\times100\times0.2,$$

cohesion (%) is calculated as $$\text{cohesion}(\%)=X+Y+Z.$$

Figure 10:
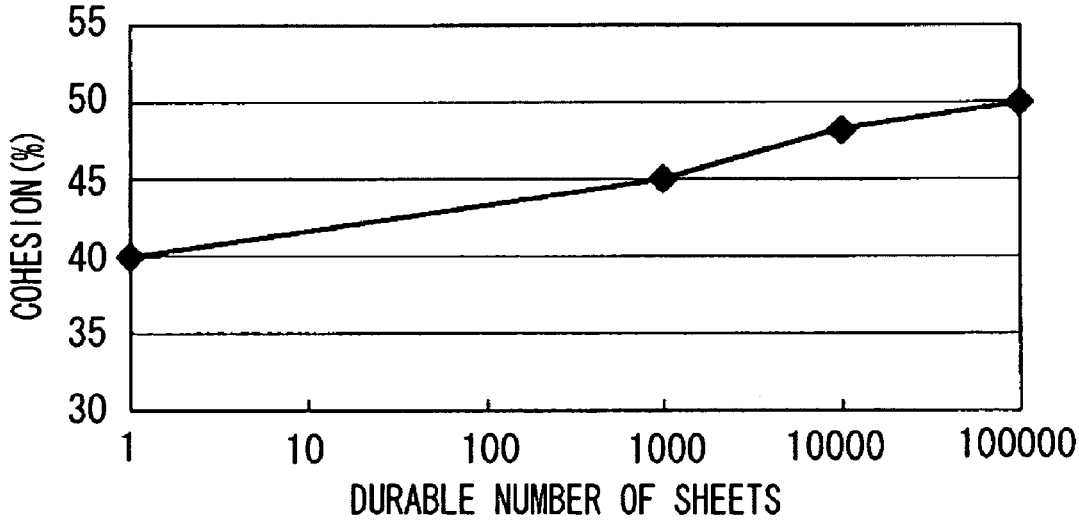
FIG. 10 illustrates a relation between durable number of sheets and change in toner cohesion.

FIG. 10 illustrates a change in cohesion of toner according to a durable number of sheets. In a durability mode, an original in which an image duty (i.e., image ratio) is 10% (for each color) is continuously formed on an A4 size paper in a normal temperature/normal humidity (23° C., 50% RH) environment. As illustrated in FIG. 10, cohesion of toner increases according to the durable number of sheets. In the present exemplary embodiment, cohesion of toner is set to 40%.

As a result of the above-described process, the frequency of the vibration mode in the present exemplary embodiment is set for a A4 size original as described in the table below.

Image Ratio and Vibration Mode Frequency

| Image duty | Vibration mode frequency |
|---|---|
| 2% | Every 200 sheets |
| 4% | Every 1000 sheets |
| 6% or greater | Every 5000 sheets |

As described above, according to the first exemplary embodiment of the present invention, vibration is applied at appropriate timing according to brightness of toner. As a result, the toner layer is removed from the back side of the regulating blade 46 before the toner layer grows. In addition, there is no image defect due to discharging the aggregate (foreign substance), and an image forming apparatus that does not unnecessarily stop image formation can be provided.

Further, the present invention is not limited to a material of a photosensitive drum and developer used in the image forming apparatus and the configuration of the image forming apparatus described above in the present exemplary embodiment. The present invention is applicable to various developers and image forming apparatuses. To be more specific, color and number of colors of toner, order of developing each color toner, method of vibrating the vibration member, a threshold value of the image ratio of the vibration mode, and a number of developer bearing members are not limited to those discussed in the present exemplary embodiment.

Second Exemplary Embodiment

Figure 11:
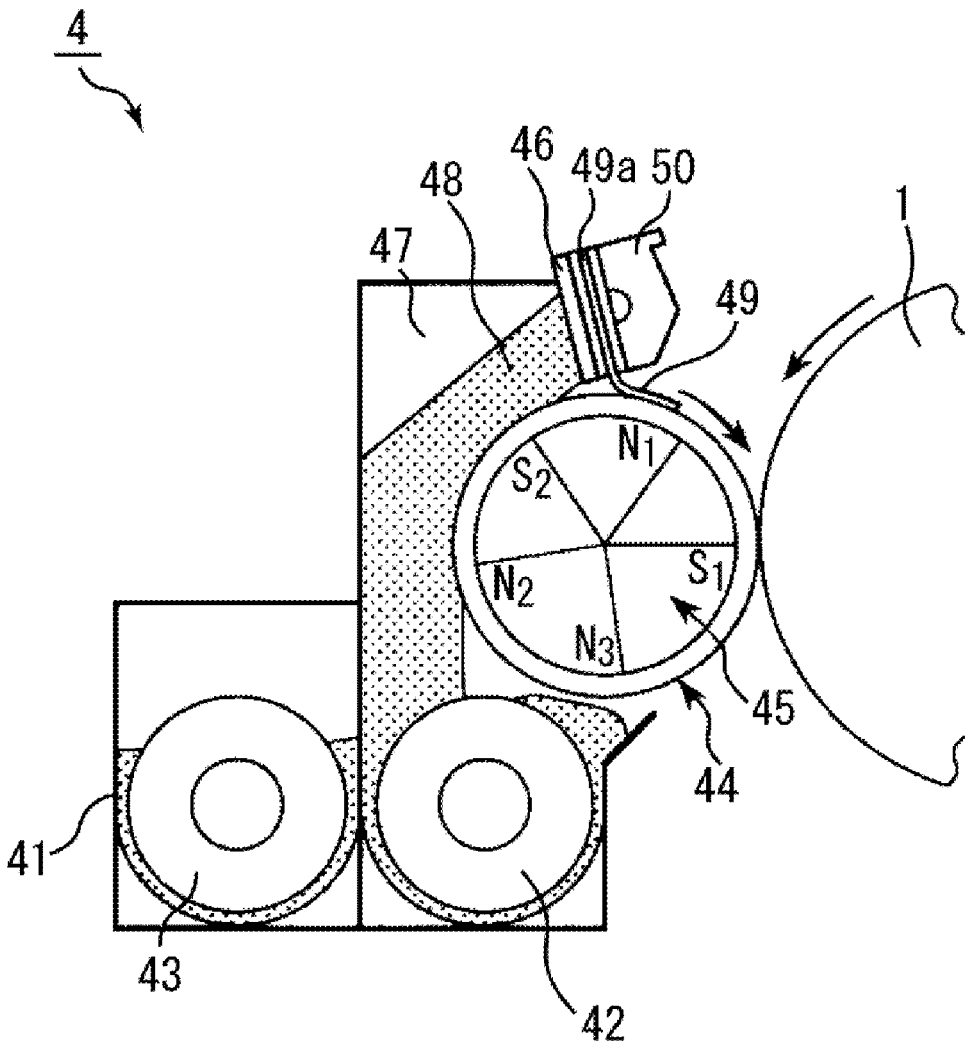
FIG. 11 illustrates a cross-sectional view of a developing device according to an exemplary embodiment of the present invention.

Basic configurations of an image forming apparatus and a developing device described in the present exemplary embodiment are similar to those described in the first exemplary embodiment, and description of the entire image forming apparatus will be omitted. FIG. 11 illustrates a developing device according to the present exemplary embodiment.

Referring to FIG. 11, according to the second exemplary embodiment, a flexible sheet member 49 for crushing an aggregate is formed downstream from the regulating blade 46 in a rotational direction of the developing sleeve 44 and upstream from a position at which the developing sleeve 44 faces the photosensitive drum 1. The flexible sheet member 49 can improve image defect due to an aggregate.

In FIG. 11, the flexible sheet member 49 is fixed on the regulating member 46 by a double-sided adhesive tape 49*a*. In the present exemplary embodiment, a mylar sheet of 50 μm thick is used as the flexible sheet member 49. The flexible sheet member 49 contacts the developing sleeve 44 across the developer. Therefore, the flexible sheet member 49 can crush the aggregate discharged by vibration.

However, since the flexible sheet member 49 is required to contact the developing sleeve 44 without blocking a developer coat on the developing sleeve 44, the flexible sheet member 49 cannot crush all of the aggregate. Instead, the flexible sheet member 49 can only crush a small aggregate. Therefore, the effect of the flexible sheet member 49 is merely of a level subsidiary to the first exemplary embodiment. However, an image smearing caused by the aggregate is improved by the flexible sheet member 49.

Third Exemplary Embodiment

Basic configurations of an image forming apparatus and a developing device described in the present exemplary embodiment are similar to those described in the first exemplary embodiment, and description of the entire image forming apparatus will be omitted.

In a third exemplary embodiment, a system using toner particles including a wax component will be described. The toner particles used in the present exemplary embodiment will be described below.

The toner particles according to the present exemplary embodiment use pulverized toner including a wax component to attain oilless fixation. It is useful that a 1 to 20% by weight of wax is included in the toner particle. If the wax is less than 1% by weight, a separation failure may occur in the fixing device. Further, if the wax exceeds 20% by weight, a desired toner charging amount per unit weight (hereinafter referred to as Toribo) cannot be applied. Further, cohesion of the toner increases, so that a vibration frequency of the vibration member needs to be increased, causing lowering of productivity.

Therefore, the present exemplary embodiment uses a pulverized toner including wax of 1 to 20% by weight as the toner particles to achieve oilless fixation.

In the present exemplary embodiment, the toner particles are acquired by pulverizing and classifying after mixing and kneading binder resin, wax, colorant, and charge regulating agent. However, the method of producing the toner particles is not limited to the above-described method and can be produced by any of kneading, freezing, and pulverizing. Further, other additives can be included.

Pulverized toner can be produced at comparatively low cost as compared to other toners such as polymerization toner. However, the toner component tends to exist near the toner surface layer due to the production method. Consequently, the wax tends to exude onto the developing sleeve 44, and as a result, cohesion of the toner tends to become high. When such a toner is used, toner cohesion as described in the first exemplary embodiment is easily generated. Therefore, an amount of developer coat on the developing sleeve 44 becomes thin at a portion in which the aggregate has grown as compared to other portions, and density of an image becomes low.

To solve such a problem, vibration is applied to move and loosen the toner layer. As a result, the toner layer is discharged outside the regulating blade 46, so that the amount of developer coat is prevented from becoming small. It is more effective when the above-described toner is used.

A configuration of the image forming apparatus according to the present invention is not limited to those described above in the three exemplary embodiments.

For example, in the above-described exemplary embodiment, the image forming apparatus according to the present invention employs an intermediate transfer method using the intermediate transfer belt 51 as an intermediate transfer member.

However, the image forming apparatus of the present invention is not limited to the above method. For example, the image forming apparatus can use a direct transfer method. More specifically, an electrostatic transfer belt as a recording material bearing member can carry and convey the recording material S, instead of the intermediate transfer belt 51 in the transfer device 5 according to the above-described exemplary embodiment. Consequently, the toner image is transferred to the recording material S.

The present invention can be similarly applied to an image forming apparatus using the above-described direct transfer method to achieve a similar result.

Such an image forming apparatus using a direct transfer method is well known to those skilled in the art, and further description will be omitted.

As described above, according to the present invention, a toner layer can be removed from the back side of the regulating blade 46 and a favorable image without defect can be acquired by vibrating the regulating blade 46. Further, a defective image is not formed by a foreign substance that is generated after vibrating the regulating blade 46, and a down time of image formation can be minimized.

An image forming apparatus according to the present invention vibrates a developer layer thickness regulating member. As a result, a toner layer is removed from the back side of the developer layer thickness regulating member, and growth of the toner layer originating on the developer layer thickness regulating member is prevented. Therefore, a favorable image without a defect can be acquired. Further, a defective image due to a foreign substance generated by vibrating the developer layer thickness regulating member is not formed, and a down time of image formation can be minimized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2007-265680 filed Oct. 11, 2007, which is hereby incorporated by reference herein in its entirety.

What is claimed is:

1. An image forming apparatus comprising:

a plurality of image bearing members on which an electrostatic image is formed;

a plurality of developer bearing members configured to rotate while bearing a developer and to develop an electrostatic image on the image bearing member at a position facing the image bearing member, respectively;

a plurality of regulating members configured to regulate a developer layer thickness on the developer bearing member, respectively;

a plurality of vibration members configured to vibrate the regulating members, respectively; and a control unit that can execute a vibration mode which actuates the plurality of vibration members during different periods so that the regulating members do not vibrate simultaneously.

2. An image forming apparatus according to claim 1, wherein the regulating member of the developing device that contains a developer including a toner whose color brightness is highest is vibrated last in the vibration mode.

3. An image forming apparatus according to claim 1, wherein the regulating member of the developing device that contains a developer including a toner whose color brightness is lowest is vibrated first in the vibration mode.

4. An image forming apparatus according to claim 1, wherein the regulating members are vibrated in the vibration mode in an order from the regulating member of the developing device that contains a developer including a toner whose color brightness is lower to the regulating member of the developing device that contains a developer including a toner whose color brightness is higher.

5. An image forming apparatus according to claim 1, further comprising a flexible sheet member that contacts the developer downstream from the regulating blade and upstream from a position at which the developer bearing member faces the image bearing member in a rotational direction of the developer bearing member.

6. An image forming apparatus according to claim 1, further comprising a measurement unit configured to measure an image ratio of an image that is formed by image signals based on image information, wherein a frequency of executing the vibration mode is changed according to the image ratio.

7. An image forming apparatus according to claim 6, wherein the measurement unit is a video count unit that counts the image signals.

8. An image forming apparatus according to claim 7, wherein the toner contains 1 to 20% of wax by weight.

9. An image forming apparatus according to claim 7, wherein the toner is acquired by pulverization after mixing and kneading at least a binder resin, a colorant, and wax.

10. An image forming apparatus according to claim 1, wherein the toner contains wax.

* * * * *